US008141990B2

(12) United States Patent
Pidwerbecki et al.

(10) Patent No.: US 8,141,990 B2
(45) Date of Patent: Mar. 27, 2012

(54) INK EJECTION DEVICE

(75) Inventors: David Pidwerbecki, Corvallis, OR (US); Tsuyoshi Yamashita, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 319 days.

(21) Appl. No.: 12/623,843

(22) Filed: Nov. 23, 2009

(65) Prior Publication Data

US 2011/0122206 A1 May 26, 2011

(51) Int. Cl.
*B41J 2/045* (2006.01)
*B41J 2/14* (2006.01)
*B41J 2/16* (2006.01)

(52) U.S. Cl. ..... 347/71; 347/47

(58) Field of Classification Search ..... 347/47, 347/65, 68, 70–72, 54
See application file for complete search history.

(56) References Cited

U.S. PATENT DOCUMENTS

| | | | | |
|---|---|---|---|---|
| 6,290,331 | B1 | 9/2001 | Agarwal et al. | |
| 6,450,615 | B2 | 9/2002 | Kojima et al. | |
| 6,527,370 | B1 | 3/2003 | Courian et al. | |
| 7,520,591 | B2 | 4/2009 | Suzuki | |
| 7,530,668 | B2 | 5/2009 | Tomita et al. | |
| 7,766,462 | B2 * | 8/2010 | Haluzak et al. | 347/71 |
| 2002/0154191 | A1 | 10/2002 | Kanda et al. | |
| 2007/0200896 | A1 | 8/2007 | Ozawa et al. | |
| 2009/0051740 | A1 | 2/2009 | Hiroshima | |

* cited by examiner

*Primary Examiner* — Matthew Luu
*Assistant Examiner* — Lisa M Solomon

(57) ABSTRACT

A side shooting ink ejection device may comprise a front surface, side shooting nozzles having ejection orifices for ejecting fluid, and piezoelectric actuators for moving the fluid through vibration for ejecting the fluid out of the nozzle. The side shooting nozzles may be arranged to eject fluid in a side direction of the piezoelectric actuator. The front surface may comprise recessed portions. The side shooting nozzles may open into the recessed portions so that the ejection orifices are countersunk with respect to the front surface.

10 Claims, 3 Drawing Sheets

15
8

16
15
8

17
15
17
8

16
16
17
8

17A
17A
17A
20
5
17B
4
8

17
20
5
4
C
8
C 10
21
8

11
22
11
8

2
8A
23
A
8B
2
D
1
C

INK EJECTION DEVICE

BACKGROUND OF THE INVENTION

At present, particular types of ink jet printers apply side shooting print heads. Typically, these print heads involve nozzles that shoot in a side direction with respect to a piezoelectric element, and parallel to the silicon wafer. Side shooting piezo print heads allow firing chambers to be placed on both sides of a silicon wafer. This feature allows maximizing the nozzles per linear inch per area of silicon wafer and allows tight packing of print heads in a printer which reduces the carefully controlled paper print zone Manufacturing these types of print heads involves cutting out a nozzle and an ink chamber in a photolithographic silicon etch process, adhering a flexible membrane above the nozzle and chamber, and adhering a piezoelectric actuator on the membrane positioned above the nozzle and ink chamber. A nozzle orifice surface and the nozzle orifice of the print head are formed by dicing the wafer. The nozzle consists of a converging zone that provides a fluidic path between the chamber and the nozzle orifice. The nozzle orifice consists of a near rectangular opening with a short straight wall region normal to nozzle orifice. A straight region, the chimney, is provided between the converging zone and the orifice, and directs the accelerating fluid flow that will eventually produce the ink drop. The piezoelectric element deforms the membrane which in part provides the acoustic pressure in the ink chamber that ejects the ink from the nozzle orifice in a direction perpendicular with respect to the piezoelectric element/membrane primary deflection direction.

As the nozzle orifice is formed by wafer dicing, process irregularities such as chips are formed along the edges of the nozzle orifice. These irregularities may adversely affect nozzle orifice ink wetting consistency and meniscus shape that is formed near the nozzle orifice. In practice, the drop trajectory may deviate significantly from the intended direction due to interaction of the fluid with the irregularities. Furthermore, the chimney length may vary significantly between different print heads due to the relatively large tolerance imposed by the sawing process.

Currently the nozzle orifice surface is polished to counter irregularities in the sawn surface. Afterwards, the entire die, both outside and inside the nozzles and the chamber, are cleaned. Such polishing and cleaning is a slow and expensive process and generally produces significant yield fall out due to incomplete cleaning and other grit particle induced defects.

Furthermore, during etching undesirable irregularities are formed on nozzle surface opposed to the membrane surface in the chimney region of the nozzle. In use, these irregularities cause asymmetric meniscus shape in the nozzle orifice, that further affect drop trajectory.

A goal of the invention is to alleviate at least one of above drawbacks.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description through modification, combination or variation of certain elements. Furthermore, it may be understood that also embodiments or elements that may not be specifically disclosed in this disclosure may be derived from the description and drawings.

Figure 1:
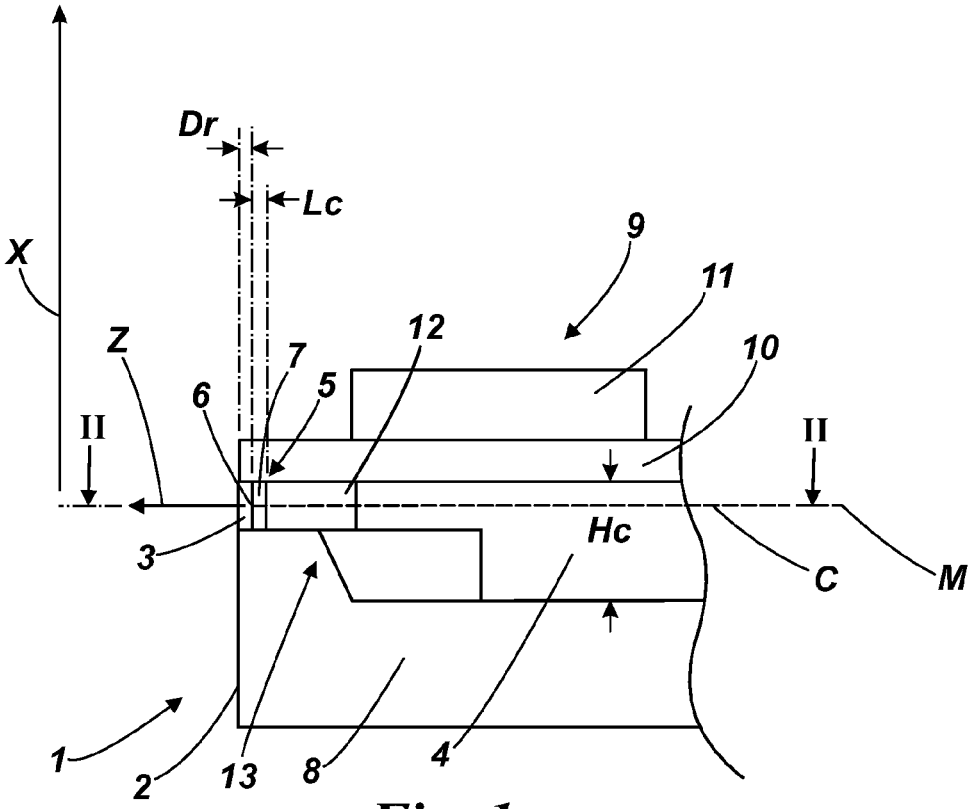
FIG. 1 is a schematic side view of a side shooting ink ejection device.
Figure 2:
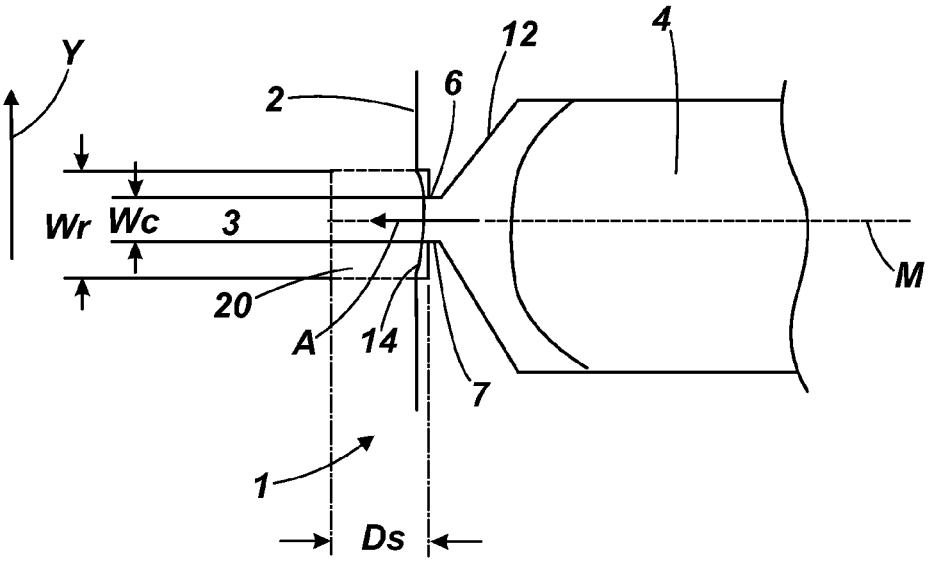
FIG. 2 is a schematic cross sectional top view of the side shooting ink ejection device of FIG. 1.

FIGS. 1 and 2 show a part of a side shooting ink ejection device 1 in cross sectional side view and cross sectional top view, respectively. The ink ejection device 1 comprises a front surface 2. In the front surface 2, a recessed portion 3 may be provided. The ink ejection device 1 may comprise a fluid chamber 4 and a nozzle 5. The nozzle 5 may open into the recessed portion 3. The nozzle 5 may comprise an ejection orifice 6, opening into the recessed portion 3. The recessed portion 3 may be wider than the ejection orifice 6, as can be seen in FIG. 2. The nozzle 5 may further comprise a chimney 7, extending between the recessed portion 3 and the fluid chamber 4, which may define a narrowing portion of the fluid chamber 4.

The ink ejection device 1 may form part of a side shooting piezoelectric inkjet printhead (not shown). The printhead may comprise a front surface 2 having multiple recessed portions 3, for example a grid of recessed portions 3, wherein a nozzle 5 opens into each of the recessed portions 3. The nozzle 5 and the ink chamber 4 may together comprise one cutout in a wafer 8. Such cutout may be achieved by photolithography, as will be explained further below, and/or another manufacturing process.

The ink ejection device 1 may comprise a piezoelectric actuator 9. The actuator 9 may comprise a membrane 10 and a piezoelectric element 11, as shown schematically in FIG. 1. The membrane 10 may form a top wall of the fluid chamber 4. The piezoelectric element 11 may extend on top of the chamber 4, while the nozzle 5 may extend at the side of the chamber 4. The vibrations of the piezoelectric element 11 may be transported through the membrane 10 so as to generate acoustic waves and/or pressure in the fluid in the fluid chamber 4 and have the fluid shoot out through the nozzle 5 in a side direction. For one fluid chamber 4, one or more piezoelectric elements 11 may be connected to the membrane 10. In an embodiment, the membrane 10 may extend along the entire fluid chamber 4 and the piezoelectric element 11 covers a part of the fluid chamber 4. The piezoelectric element 11 may comprise piezoceramic material or any other suitable material.

Below, for an understanding of possible common geometrical relationships between features of the side shooting ink ejection device 1, the terms "common plane", "shooting direction" and "middle axis" are introduced.

The nozzle 5 may comprise a side shooting nozzle, shooting in a side direction with respect to the actuator 9, for example, in a shooting direction Z. The shooting direction Z may be approximately perpendicular to a normal vector that defines the surface of the actuator 9, such as direction X, or the surface of the membrane wall 10. An imaginary common plane C may extend through the nozzle 5, the fluid chamber 4 and the recessed portion 3 so that the nozzle 5, the fluid chamber 4 and the recessed portion 3 may be arranged in line. The common plane C may extend through the ink ejection orifice 6 and the chimney 7 and may be parallel to the membrane 10. A normal vector of the common plane may be direction X. The shooting direction Z and/or the nozzle 5 may be arranged approximately perpendicular to the normal vector defining common plane C, i.e. direction X. The shooting direction Z may lie in the common plane C. As can be seen from FIG. 1, the fluid chamber 4, the nozzle 5 and the recessed portion 3 may be in line, extending along the common plane C. The main shooting direction Z of the ink ejection device 1 may represented by the ideal ink shooting direction, i.e. straight out of the nozzle 5.

The actuator 9 may extend next to the common plane C. "Next to" may refer to the common plane C not intersecting the actuator 9. For example, in the drawing, the actuator 9 extends above and parallel to the common plane C. However, depending on the orientation of the print head, the actuator 9 may extend under or at the sides of the common plane C. The actuator 9 may act as a top and/or bottom wall of the fluid chamber 4.

A common middle axis M may extend through the middle of the fluid chamber 4, the middle of the chimney 7 and the middle of the recessed portion 6, as seen from a top view (FIG. 2) and/or an X-direction that may be the normal vector of the common plane C. The middle axis M may extend approximately parallel to and/or may coincide with the shooting direction Z of the fluid. The common middle axis M may lie in the common plane C. The common middle axis M may extend approximately perpendicular to the vector that is normal to the surface of the actuator 9, or the membrane wall 10. A scan direction X of the print head may be approximately perpendicular to the shooting direction Z. The scan direction X may be perpendicular to the common plane C, a normal vector defining the common plane C.

The ink ejection device 1 may be arranged to guide the fluid towards the ejection orifice 6 by pressure and/or acoustic waves. The actuator 9, or at least the membrane 10, may be arranged parallel to the shooting direction Z of the fluid. The fluid chamber 4 may converge towards the chimney 7. The fluid chamber 4 may comprise a converging portion 12 to guide the fluid towards the nozzle 5. The converging portion 12 may converge in the direction of the chimney 7 and connect to the chimney 7. The bottom and/or the side walls of the fluid chamber 4 may converge and/or taper towards the chimney 7. For example, the fluid chamber 4 may comprise a stepped portion 13. For example, the fluid chamber 4 may comprise a chamber bottom 14 that is deepened with respect to the nozzle 5 and/or the common plane C.

The chimney 7 may comprise substantially parallel walls. The chimney walls may be substantially straight. The walls of the chimney may extend substantially parallel to the shooting direction Z of the fluid. The chimney walls may end at the recessed portion 3, wherein the end edges of the chimney walls may form the ejection orifice 6. The recessed portion 3 may comprise a widening with respect to the ejection orifice 6 and may open into the front surface 2 so that the ejection orifice 6 may be countersunk.

The height Hc of the fluid chamber may be 150 micron or less, as measured between the bottom of the fluid chamber 4 and the surface of the actuator 9 forming the top wall of the fluid chamber 4. The length Lc of the chimney 7 may be between approximately 2 and approximately 40 micron, for example between approximately 5 and approximately 20 micron. The width Wc of the chimney 7 may be between approximately 10 and approximately 100 micron, for example between approximately 20 and approximately 70 micron. These dimensions have shown to be advantageous for obtaining a desired and constant ink drop weight, velocity and frequency.

The depth Dr of the recessed portion 3, as measured between the ejection orifice 6 and the front surface 2, may be between 3 and 30 micron. A width difference between the outer edge of the recessed portion and the outer edge of the ejection orifice may be between 3 and 100 micron, for example between 3 and 20 micron. Herein, the width difference may be calculated by subtracting the width Wc of the Chimney from the width Wr of the recessed portion.

Above features and dimensions may be advantageous for obtaining a desired and constant ink drop weight, velocity and frequency. Above features and dimensions have been tested and have shown to achieve relatively good results with respect to the drop directionality of the respective tested ink drop.

For example, with the use of the recessed portion 3, a meniscus 14 (FIG. 2) of the fluid may pin in the recessed portion 3. The recessed portion 3 may act as a cup. Since the ejection orifice 6 may be a critical part of the nozzle 5, countersinking the ejection orifice 6 with respect to the front surface 2 may move the ejection orifice 6 away from the front surface 2. This may prevent that irregularities that may be formed in the front surface 2 would affect drop directionality or meniscus shape. The drop directionality control may be improved by the use of the recessed portion 3. The meniscus 14 being formed in the recessed portion 3 may have a relatively high level of symmetry, which may improve the drop directionality. The recessed portion 3 may allow for an extra amount of fluid to be located near the ejection orifice 6, at least partly in the recessed portion 3, which may in this context also be referred to as "ink cup region". This may allow for extra control of the drop weight and drop velocity, especially at low frequencies. The extra ink in the recessed portion 3 may allow for more ink to be available in the nozzle region for low frequency drop eject, providing an effective higher drop weight upon ejection. Typically, the drop weight may be lower at lower operating frequencies, because the acoustic energy has had time to dampen out and the chamber is essentially quiescent between firing events. As the nozzle is fired at higher frequencies, the meniscus may not refill the recessed portion 3, but rather be pinned in the chimney 7. At higher frequencies, the chamber 4 may have more available energy from previous firing events, which provides more ink into the drop. The recessed portion 3 may modulate the amount of available ink for ejection with the available energy to eject the ink.

An embodiment of a manufacturing process of the side shooting ink ejection device 1 may be explained with reference to FIGS. 3A-I, and FIG. 4. Each of FIGS. 3A-I may represent an exemplary state of a wafer 8 for manufacturing a side shooting ink ejection device 1 in a photolithographic process. However, the skilled person will understand that other manufacturing methods may also be suitable.

An exemplary wafer 8 for use in a manufacturing process for an ink ejection device 1 may comprise a silicon wafer having a width of approximately 8 inch (approximately 200 millimeter) and a thickness of approximately 1061 micron. The wafer 8 may be coated with a layer 15 of silicon dioxide by any suitable method. In an embodiment, the silicon dioxide layer 15 may comprise Field Oxide (FOX), for example of a thickness of approximately 2 micron.

Figures 3A, 3B, 3C, 3D, 3E, 3F, 3G, 3H, 3I:
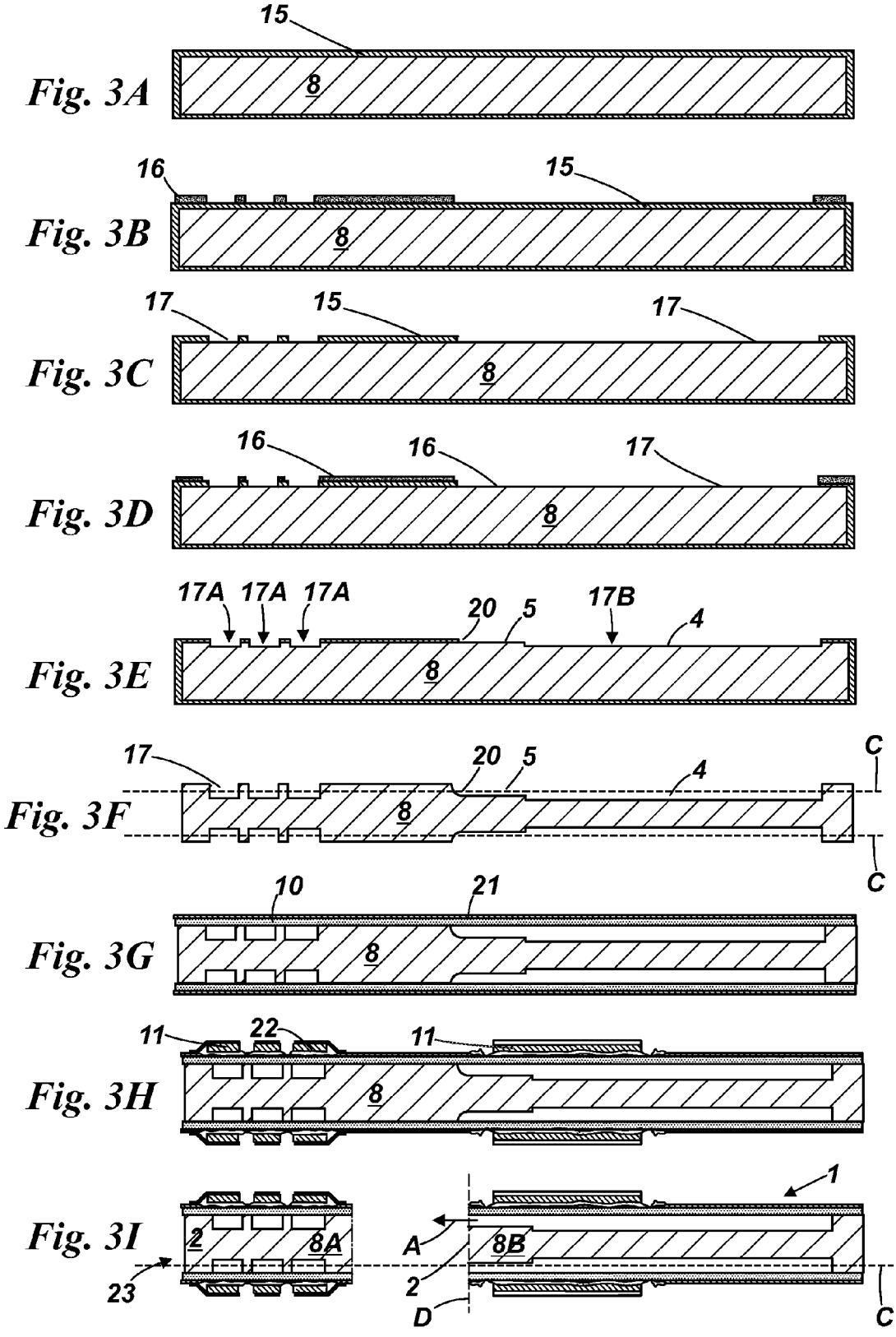
FIG. 3A-I show several stages of a schematically illustrated side shooting ink ejection device in a method of manufacturing such device.

As shown in FIG. 3B, a mask 16 may be deposited onto the wafer 8. The mask 16 may comprise any suitable removable protective layer. In the shown embodiment, the wafer 8 may be exposed to light so that the exposed parts of the wafer 8, which are not covered by the mask 16, may become soluble in a developer fluid. In another embodiment (not shown), exposed wafer parts may become insoluble, and the mask 16 corresponds to the cutouts 17 that are to be formed. Afterwards, the developer fluid may be applied and the protective layer may be removed so that cutouts 17 are formed, as shown in FIG. 3C.

As shown in FIGS. 3D and 3E, a second exposure and development process may be applied to the wafer. Before said second exposure, a second mask 16 may be applied to the wafer 8, wherein the mask 16 may cover respective parts of the cutouts 17, as shown in FIG. 3D. In this way, said parts of the cutouts 17 may be deepened. For example, the bottom of the fluid chamber 4 may be formed at a deepened level with respect to the nozzle 5. Accordingly, one or more layers may be cut out in one or more steps. Multiple subsequent exposure, development and etching process may be applied for achieving a desired cut out 17. Each cutout 17 may comprise a fluid chamber 4, a chimney 7 being narrower than the chamber 4, a sacrificial portion 20 that is wider than the chimney 7 and/or a chamber 4 being deeper (or higher) than the chimney 7.

The sacrificial portion 20 may correspond to the recessed portion 3. The function of the sacrificial portion 20 will be explained further below. In the shown cross section of the wafer 8, three cutouts 17A corresponding to respective ink ejection devices 1 are shown in cross sectional front view, and one cutout 17B corresponding an ink ejection device 1 is shown in side view. Formation of the cutouts 17 may involve further ashing, stripping and etching processes.

Figure 4:
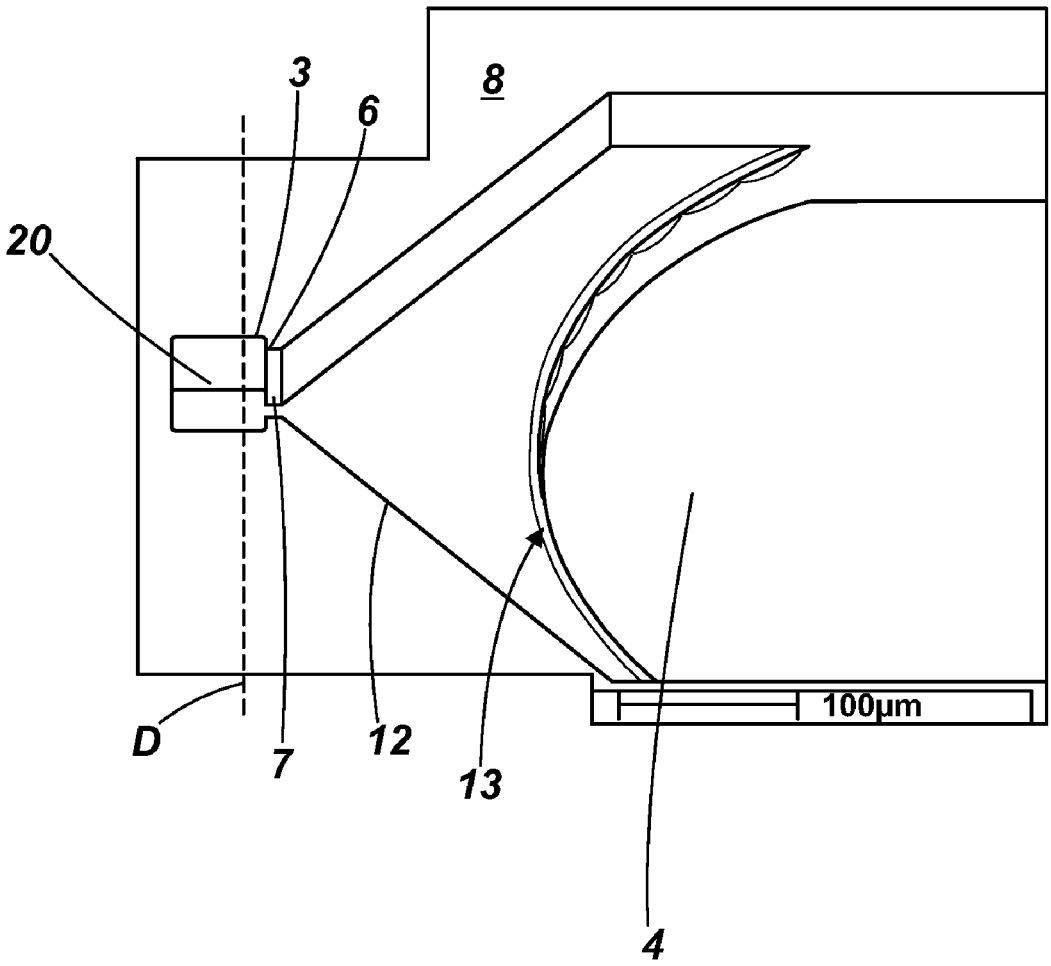
FIG. 4 is a perspective view of a cutout representing a part of an ink chamber, chimney and sacrificial portion, at a similar stage as FIG. 3E or 3F.

A part of one cutout 17 in a wafer 8 is shown in perspective view in FIG. 4. The wafer 8 of FIG. 4 may correspond to the embodiment shown in FIG. 3F. The cutout 17 of FIG. 4 may comprise a chimney 7, a sacrificial portion 20, a fluid chamber 4, and an ejection orifice 6. FIG. 4 will be further discussed below.

As shown in FIG. 3F, cutouts 17 may be formed on both sides of the wafer 8. A common plane C may extend through the respective nozzle 5, fluid chamber 4 and sacrificial portion 20. The photoresist layer 15 may have been removed from the wafer 8.

As shown in FIG. 3G, an actuator membrane 10 may be applied to the wafer 8, so as to cover the respective cutouts 17. For example, the membrane may be properly ground, polished, etched and cleaned to achieve a proper thickness for vibration and to prepare it for the deposition of an electrode 21 and/or piezoelectric elements 11. Optionally, the electrode 21 may be applied to the membrane 10, for example as a layer and/or pattern.

As shown in FIG. 3H, piezoelectric elements 11 may be applied to the membrane 10 and/or the electrode 21. Piezoelectric material may be deposited, adhered, cured, ground and/or cleaned on both sides of the wafer 8. The piezoelectric material may be deposited as a layer, along multiple cutouts 17. A second electrode 22 may be deposited on top of the piezoelectric. Afterwards, the material may be trimmed so that one or more piezoelectric elements extend along each respective cutout 17. For example, in a finalized in ejection device 1, the actuators 9, including the piezoelectric elements 11, may have a thickness of approximately 45 micron, for example between 2 and 100 micron.

As shown in FIG. 3I, the wafer 8 may be diced into several dies 8A, 8B, for example along a division surface D. At least one ink ejection device 1 may be separated from an adjacent wafer part. For example, a group 23 of multiple ink ejection devices 1 may be separated from an adjacent wafer part, wherein the adjacent wafer part may comprise a second group of ink ejection devices 1. In one group 23, the ink ejection devices 1 may have approximately parallel shooting directions. As such, the group 23 of ink ejection devices 1 may together form a part of the same print head. The adjacent wafer part that is separated from the respective at least one ink ejection device 1 may for example comprise other ink ejection devices 1 and/or debris for disposal.

The front surface 2 of the ink ejection device 1 and the recessed portion 3 may be formed by dividing the wafer 8 along the division surface D, wherein the division surface D extends through the sacrificial portion 20, as shown in FIGS. 4 and 3I. The wafer 8 may be parted along a division surface D. For example, the wafer 8 may be sawn or cut along the division surface D. In an embodiment, the wafer 8 may be divided by singulation. After division, the front surface 2 may be formed along the division surface D, wherein the remaining parts of the sacrificial portions 20 may form the recessed portions 3, so that the ejection orifices 6 are countersunk with respect to the front surface 2.

In an embodiment, the sacrificial portion 20 may have a depth Ds of more than 20 micron before the division or removal of a part of the wafer 8 and a part of the sacrificial portion 20. The sacrificial portion 20 is indicated in dashed lines in FIG. 2. For example, the depth Ds of the sacrificial portion 20 may be within a range of between approximately 20 and approximately 150 micron, or between approximately 60 and approximately 100 micron. By dividing the dies 8A, 8B, the front surface 2 and the recessed portion 3 may be created. The depth of the recessed portion 3 may be 20 micron or less. The width of the sacrificial portion 20 may be the same as the width Wr of the recessed portion 3 because the width Wr is not affected by the division process.

The recessed portions 3 may allow the ejection opening 6 of the nozzle 5 to extend at a certain distance from the front surface 2. Hence, certain irregularities that may be present on the front surface 2, such as chips, may be kept away from the fluid that is ejected, which may be advantageous for controlling the directionality. Polishing of the front surface and/or the nozzles near the ejection orifices may not be necessary, since the ejection orifice 8 is moved away from the front surface 2, thereby saving time, labor and cost. The depth Dr of the recessed portion 3 may be controlled relatively easily by determining the location of division plane D and sawing or otherwise separating the wafer 8 along that plane D, while the width Wr, Wc of the recessed portion 3, the ejection orifice 6 and the chimney 7 may be manufactured and predetermined relatively precise by photolithography. The shape of the chimney 7 and the ejection orifice 6 may be determined fully be photolithographically, with more precision than state of the art side shooting chimney lengths, which were cut off by singulation and are subject to corresponding relatively large tolerances.

During the photolithography process, developer fluid, and in case of wet etching, etch fluid, may flow between the sacrificial portion 20 and the chamber 4, through the chimney 7, forming the chimney 7. The sacrificial portion 20 may allow for a certain buffer zone so that when forming the cutout 17 developer fluid may flow more freely through the chimney 7. As the chimney 7 may be relatively narrow irregular fluid movements could cause irregularities in the chimney walls. Due to the sacrificial portion 20, the fluids used to etch the chimney 7 may flow with less resistance so that relatively straight and/or smooth chimney walls may be formed. Also, the symmetry in the nozzle 5 and recessed portion 3 may be improved. Also, the dimensions and straightness of the features may amongst different ink ejection devices 1 may be relatively constant, e.g. show relatively little variation between different chimneys 7 and recessed portions 6, due to application of the sacrificial portion 20. Better reproducible and straight chimneys 7 may provide for better fluid ejection, for example better control of fluid speed and directionality, as well as better controllable and/or relatively symmetric meniscus shape. The meniscus pinning location may be relatively free of irregularities such as chips. The straight chimney 7 that may be achieved by the sacrificial and/or recessed portion 20, 3, respectively, may have an advantageous effect on the impedance within the nozzle 5.

Good results may be achieved with the dimensions as named above. The depth Ds of the sacrificial portion 20 may be chosen so as to achieve straight, reproducible nozzles 5 with good impedance results. The width Wr of the recessed portion 3 and the sacrificial portion 20 may be chosen in association with the depth Dr of the recessed portion 3, and the width We of the chimney 7 and/or ejection orifice 6, for example so as to achieve a good meniscus pinning location and distance the ejection orifice 6 from the irregularities formed by sawing.

In addition to a photolithography also other methods of manufacturing a side shooting ink ejection device 1 may be suitable. For example, a wafer 8 having cutouts 17 may be formed by building the wafer 8, while leaving open the cutout areas, for example by molding and/or any suitable nano or micro-scale construction technique. In other embodiments, cutouts 17 may be formed by laser techniques and/or or milling. Use of a sacrificial portion 20 may be suitable for application in manufacturing techniques other than photolithography.

With the side shooting ink ejection devices 1, an improved print head for printing ink onto certain media or substrates may be obtained. In a first aspect, a side shooting ink ejection device may be provided comprising a (i) front surface 2, (ii) side shooting nozzles 5 having ejection orifices 36 for ejecting fluid, and (iii) piezoelectric actuators 9 for moving the fluid through vibration for ejecting the fluid out of the nozzle 5. The side shooting nozzles 5 may be arranged to eject fluid in a side direction of the piezoelectric actuator 9. The front surface 2 may comprise recessed portions 3. The side shooting nozzles 5 may open into the recessed portions 3 so that the ejection orifices 6 are countersunk with respect to the front surface 2.

In a second aspect, a method of manufacturing a side shooting ink ejection device 1 may be provided. The method may comprise (i) forming a cutout 17 in a wafer 8, the cutout 17 comprising a chamber 4, a chimney 7 that is narrower than the chamber 4 and a sacrificial portion 20 that is wider than the chimney 7, the chimney 7 being arranged between and in open connection with the chamber 4 and the sacrificial portion 20, wherein a common plane C extends through said chamber 4, chimney 7 and sacrificial portion 20, (ii) at least partly covering the chamber 4 with a piezoelectric actuator 9, next to said common plane C, and (iii) separating a part of the wafer and a part of the sacrificial portion from the ink ejection device so that a front surface of the ink ejection device is formed that intersects with the common plane, and the left over sacrificial portion opens into the front surface.

In a third aspect, a print head for printing ink may be provided, comprising (i) a front surface 2, (ii) side shooting nozzles 5 having ejection orifices 6 for ejecting fluid, (iii) piezoelectric actuators 9 for ejecting the fluid through vibrations, wherein the side shooting nozzles are arranged to eject fluid in a side direction of the piezoelectric actuator 9, the front surface 2 comprises recessed portions 3, and the side shooting nozzles open into the recessed portions 3 so that the ejection orifices 6 are countersunk with respect to the front surface 2.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

The mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. Side shooting ink ejection device, comprising
- a front surface,
- an ejection orifice, for ejecting fluid away from the front surface,
- a fluid chamber, for providing fluid to the ejection orifice,
- a chimney, defining a narrowing portion of the fluid chamber, extending between the fluid chamber and the ejection orifice, wherein the fluid chamber, the chimney and the ejection orifice extend in a common plane, and
- a piezoelectric actuator extending next to said common plane, for moving fluid in the fluid chamber through vibration, wherein
- a recessed portion is provided in the front surface, between the ejection orifice and the front surface, the recessed portion being wider than the ejection orifice.

2. Side shooting ink ejection device according to claim 1, wherein
- a part of the fluid chamber converges in the direction of the chimney,
- the chimney comprises substantially straight walls, and
- the recessed portion comprises a widening with respect to the chimney and opens into the front surface.

3. Side shooting ink ejection device according to claim 1, wherein a normal vector defining a surface of the actuator extends substantially perpendicular to a main shooting direction of the fluid.

4. Side shooting ink ejection device according to claim 1, comprising a relatively flat die parallel to the common plane, wherein
- the fluid chamber and the chimney comprise cutouts in two opposite faces of said die,
- the fluid chamber and the chimney are arranged so that the fluid shooting direction is approximately perpendicular to a normal vector of the common plane.

5. Side shooting ink ejection device according to claim 1, wherein the length of the chimney is between 2 and 40 micron.

6. Side shooting ink ejection device according to claim 1, wherein the width of the chimney is between 10 and 100 micron.

7. Side shooting ink ejection device according to claim 1, wherein the depth of the recessed portion, as measured between the chimney and the front surface, is between 3 and 30 micron.

8. Side shooting ink ejection device according to claim 1, wherein a width difference between the outer edge of the recessed portion and the outer edge of the ejection orifice is between 3 and 100 micron.

9. Side shooting ink ejection device according to claim 1, wherein a height of the fluid chamber is 150 micron or less, as measured between the bottom and the at least one vibrating wall.

10. Print head for printing ink, comprising a front surface, side shooting nozzles having ejection orifices for ejecting fluid, piezoelectric actuators for ejecting the fluid through vibrations, wherein the side shooting nozzles are arranged to eject fluid in a side direction of the piezoelectric actuator, the front surface comprises recessed portions, and the side shooting nozzles open into the recessed portions so that the ejection orifices are countersunk with respect to the front surface.

* * * * *